United States Patent [19]

Strathman

[11] Patent Number: 4,853,592

[45] Date of Patent: Aug. 1, 1989

[54] FLAT PANEL DISPLAY HAVING PIXEL SPACING AND LUMINANCE LEVELS PROVIDING HIGH RESOLUTION

[75] Inventor: Lyle R. Strathman, Cedar Rapids, Iowa

[73] Assignee: Rockwell International Corporation, El Segundo, Calif.

[21] Appl. No.: 166,144

[22] Filed: Mar. 10, 1988

[51] Int. Cl.[4] ..... H01J 1/54; G09G 3/26

[52] U.S. Cl. ..... 313/495; 313/500; 313/582; 340/767; 340/768; 340/811

[58] Field of Search ..... 313/495, 497, 461, 500, 313/581, 582; 340/718, 719, 704, 783, 784, 802, 805, 811, 812, 813, 767, 768, 781

[56] References Cited

U.S. PATENT DOCUMENTS 4,449,123 5/1984 Muranaga ..... 340/716
4,566,006 1/1986 Okamoto et al. ..... 340/771
4,651,149 3/1987 Takeda et al. ..... 340/805
4,660,030 4/1987 Maezawa ..... 340/784

*Primary Examiner*—Kenneth Wieder
*Attorney, Agent, or Firm*—John C. McFarren; M. Lee Murrah; H. Frederick Hamann

[57] ABSTRACT

A flat panel matrix display pixel structure emulates raster scan cathode ray tube shadow mask resolution. A display generator connected to anti-aliasing and/or dot flair circuitry activates the display. A selected pixel is fully activated and surrouding pixels are activated at a lower luminance level. As a function of the pitch of a shadow mask cathode ray tube the pixel density and the horizontal and vertical pixel spacing are derived for a monochrome matrix display, and the pixel density and the horizontal and vertical triad spacing are derived for a color matrix display panel.

26 Claims, 11 Drawing Sheets

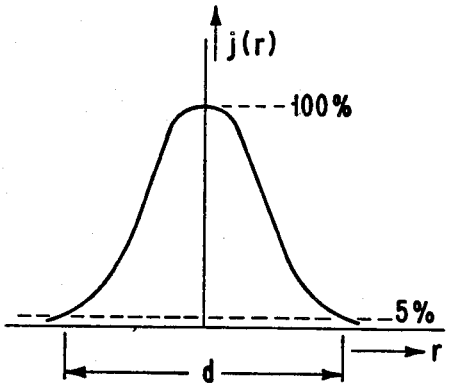
FIG 2
FIG 3A
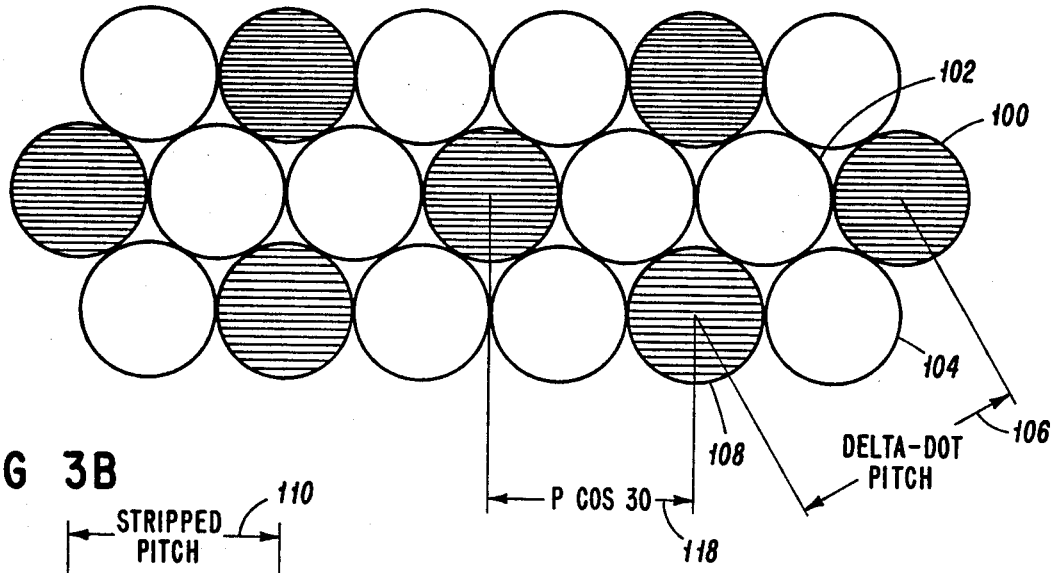
FIG 3B
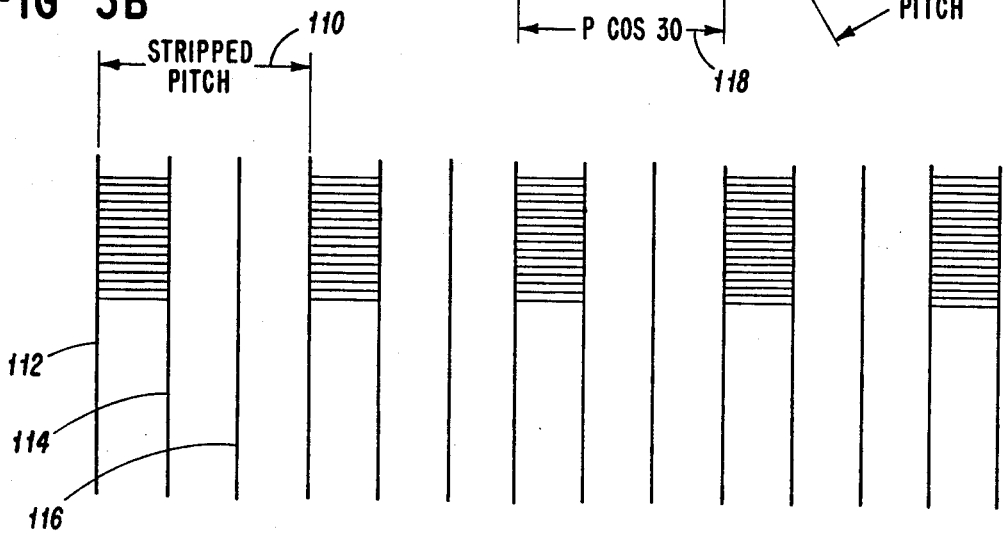

FIG 6A
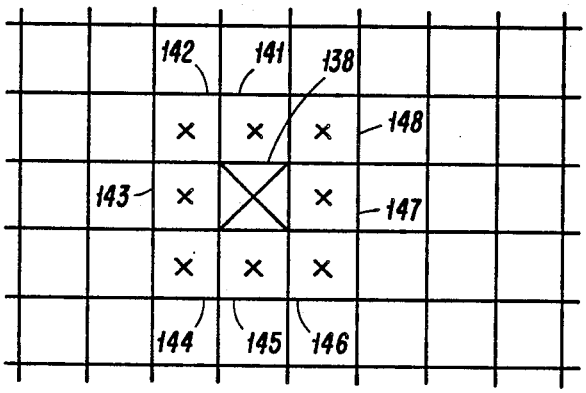
RECTILINEAR PATTERN
FIG 6B
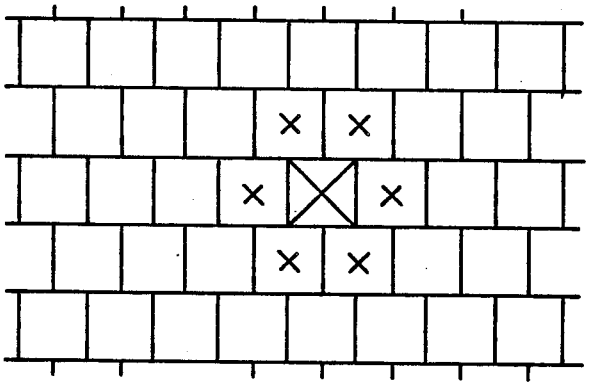
STAGGERED PATTERN
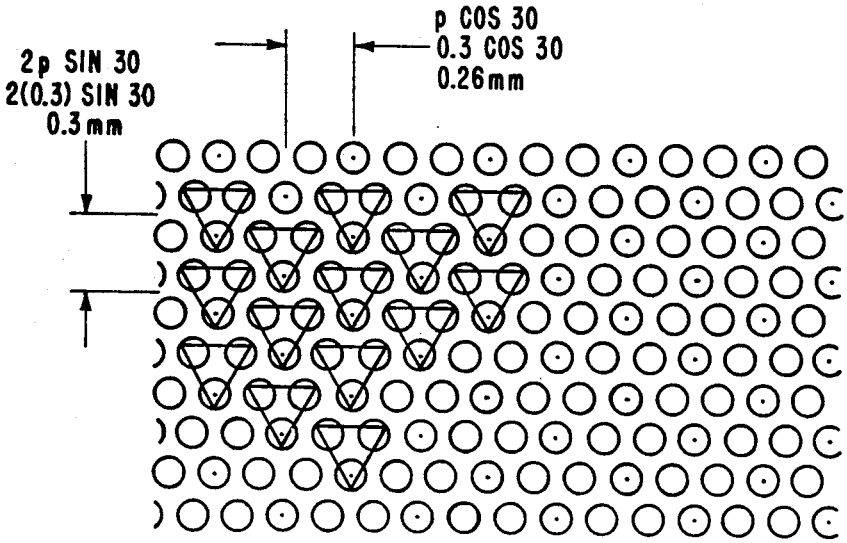
FIG 7

FIG 11A
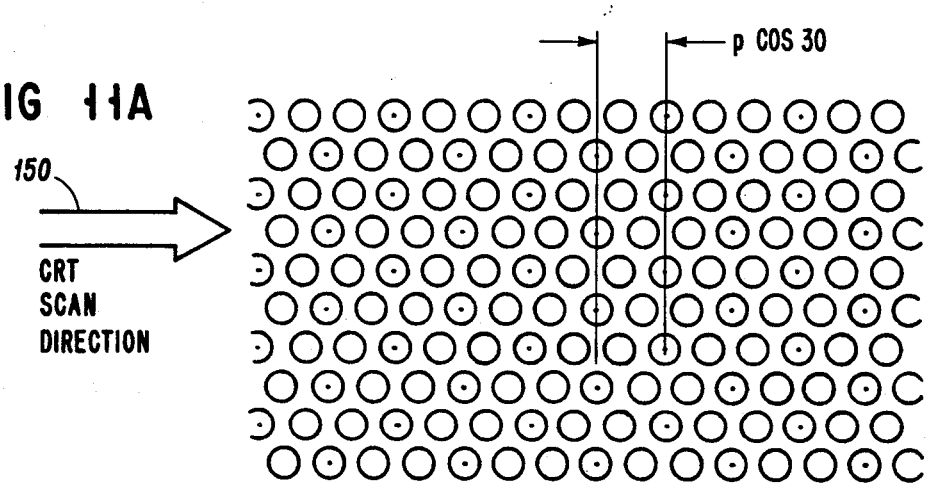
FIG 11B
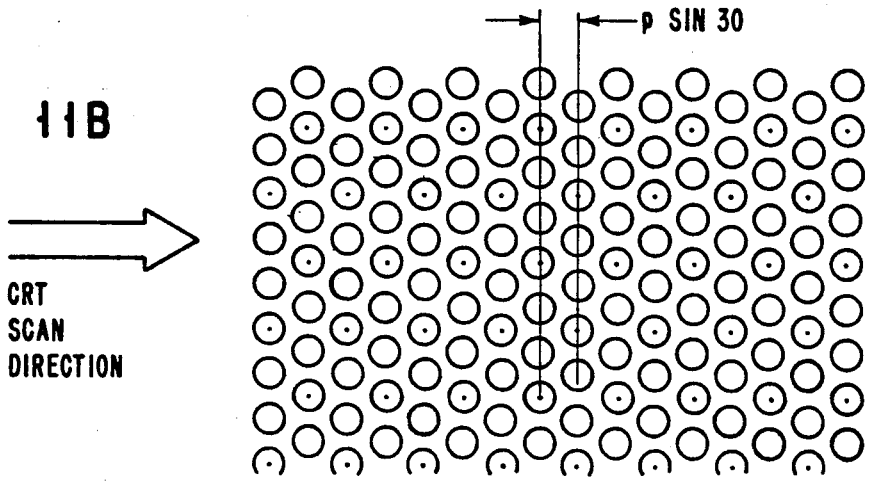
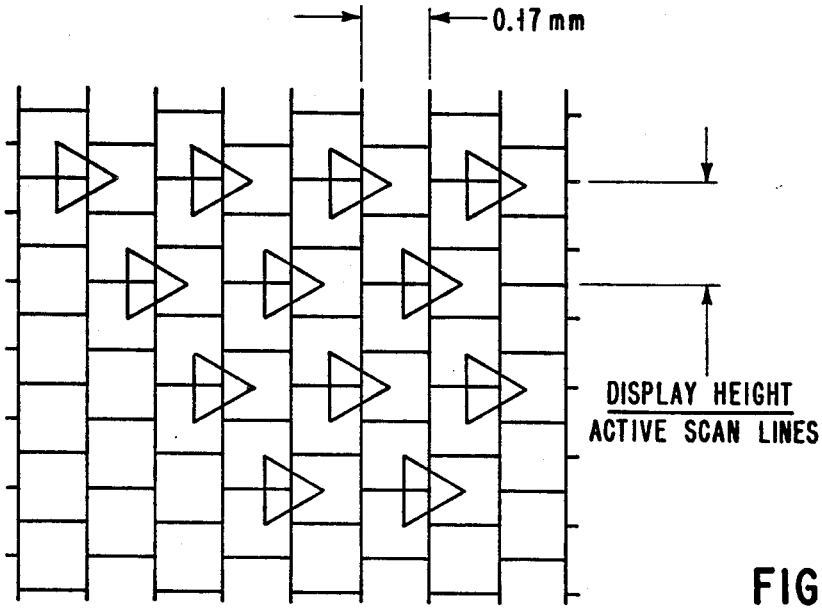
FIG 14

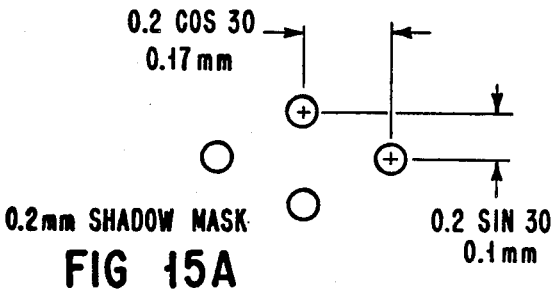
FIG 15A
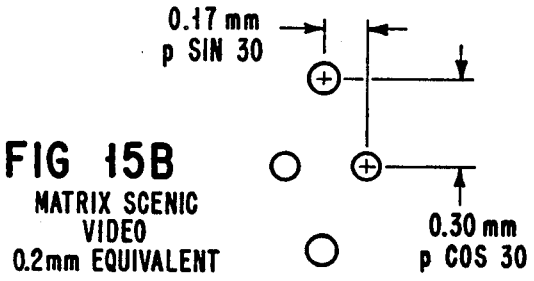
FIG 15B
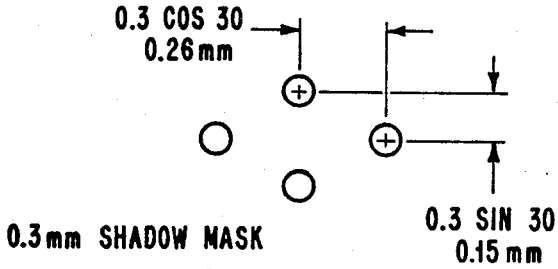
FIG 15C
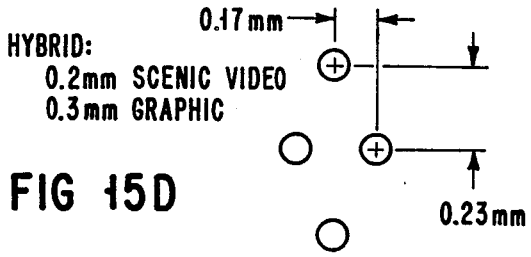
FIG 15D
FIG 16A
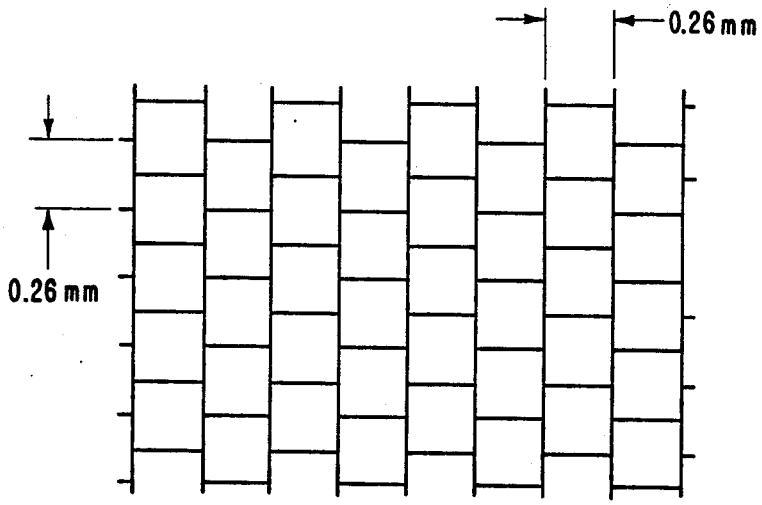
FIG 16B
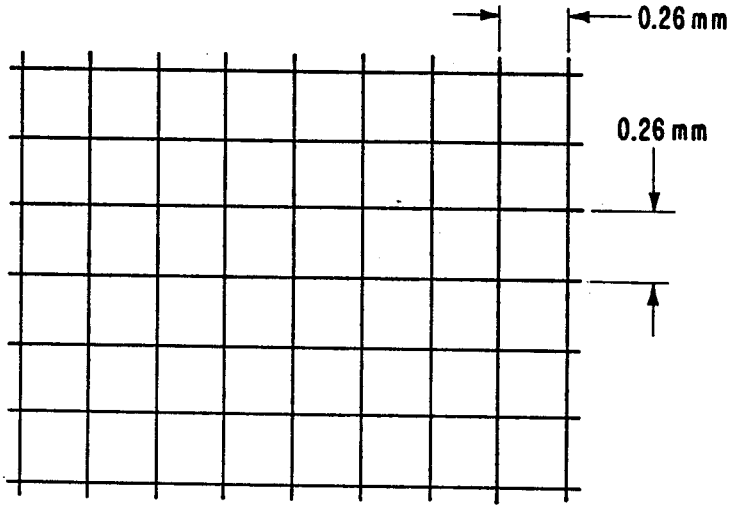

FLAT PANEL DISPLAY HAVING PIXEL SPACING AND LUMINANCE LEVELS PROVIDING HIGH RESOLUTION

BACKGROUND OF THE INVENTION

The present invention relates to flat panel matrix displays and, in particular, to a flat panel matrix display which emulates a raster scan cathode ray tube (CRT).

One of the major performance criteria of any display system is resolution, i.e., the ability of the display system to present desired data or picture content without introducing visually noticeable interference patterns or displaying media structure patterns. The advent of television intensified the invesitigation of resolution phenomena, particularly that associated with raster scanned CRTs. In TV cameras and receivers, it was found tht interactions between video bandwidth, raster structure, and picture content could cause unwanted brightness intermodulations. Should these intermodulations become observable, the resultant optical agitation might be followed by viewer visual fatigue accompanied by misinterpretation of the displayed information. When color shadow mask CRT TVs were introduced, a further reduction in resolution occurred because of the "sieve" pheonmena associated with the placement of the shadow mask between the electron beam(s) and the display surface, and because of the dispersion of the displayed picture into tri-color dots (triads) determined by the structure of the display surface. The shadow mask also introduced additional interference patterns associated with intermodulations between the mask and the modulated electron beam(s).

With recent developments of flat panel matrix display technologies, a more discerning resolution phenomena occurs where the electronic signals representing the displayed data are necessarily quantized into finitely addressable discrete picture elements, i.e., pixels. The required display data quantization necessarily mirrors the flat panel display matrix, pixel-bypixel. Since matrix pixel sizes and spacings are finitely discrete, as opposed to CRTs where analog control of the electron beam(s) allows continuous luminance gradations and analog deflection allows continuous beam(s) positioning, care must be exercised in the design of the matrix so as to preclude unwanted visible matrix structure patterns.

It is an object of the present invention to provide improved flat panel matrix displays (i.e., active matrix LCDs), which have resolution acceptable for avionic applications.

SUMMARY OF THE INVENTION

The present invention involves a flat panel matrix display pixel structure which emulates raster scan cathode ray tube shadow mask resolution. A display generator connected to anti-aliasing and dot flair circuitry activates the display. A selected pixel is fully activated and surrounding pixels are activated at a lower luminance level. As a function of the pitch of a 0.3 mm or a 0.2 mm shadow mask of a cathode ray tube, pixel density and horizontal and vertical pixel spacing are derived for a monochromatic formatted display, and pixel density, horizontal and vertical pixel spacing and horizontal and vertical triad spacing are derived for a multicolor formatted display.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several figures of which like reference numerals identify like elements and in which:

FIG. 2 is a graph of the current density distribution of a gaussion electron beam spot;

FIGS. 3A and 3B are graphical representations of delta-dot triad and striped triad phosphor arrangements;

FIGS. 6A and 6B are drawings depicting emulation of dot flair on a matrix display for a rectilinear pattern and a staggered pattern, respectively;

FIG. 7 is a drawing depicting the spacing of triads in a color cathod ray tube;

FIG. 11A is a drawing depicting the conventional direction of electron beam scanning, relative to the quantized phosphor triad, in a shadow mask cathode ray tube;

FIG. 11B is a drawing depicting an increase in horizontal resolution with orthogonal scanning, relative to the conventional scan direction, of a shadow mask cathode ray tube;

FIG. 14 is a drawing representing color scenic video matrix display resolution corresponding to a 0.2 mm pitch mask;

FIGS. 15A–D are drawings representing horizontal color scenic video matrix display resolution corresponding to a 0.2 mm pitch mask and color graphic video matrix display resolution corresponding toa 0.3 mm pitch mask;

FIGS. 16A and 16B are drawings depicting preferred embodiments of pixel structure for 0.3 mm effective monochrome graphic matrix display resolution.

DESCRIPTION OF THE PREFERRED EMBODIMENT

Figures 1A, 1B, 1C, 1D, 1E, 1F, 1G, 1H:
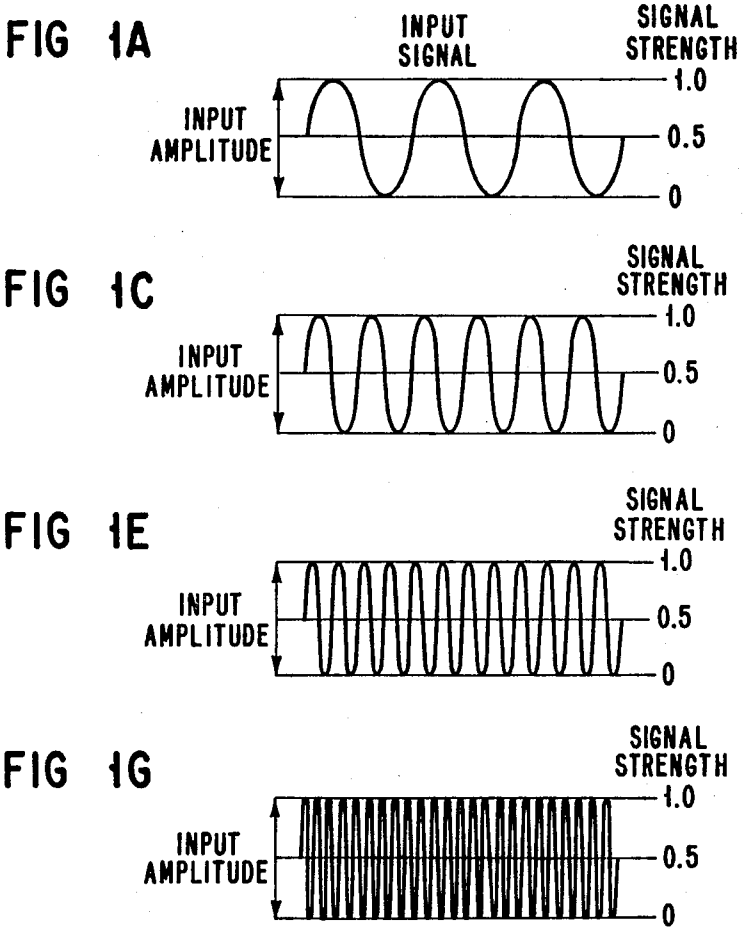
FIGS. 1A–1H are graphs depicting effective luminance response resultant from a sine wave modulated electron beam of a cathode ray tube.

The present invention has general applicability, but is most advantageously utilized in a flat panel matrix display acceptable for avionic applications.

Resolution is usually expressed in one or both of two ways. First, TV picture resolution is usually expressed in terms of so many line pairs per unit distance. This represents the best measure of a raster scanned CRT display's ability to present the viewer with "photographic" quality scenic pictures, and is expressed as "horizontal resolution of so many line pairs per unit distance at a specific modulation transfer (i.e., 65 line pairs per inch at a 10% modulation transfer)". A line pair is composed of alternate white (ON) and black (OFF) lines. The vertical resolution is predetermined by the raster format (i.e., 525, 625 or 875 line raster structure). Second, stroke scanned graphical representations require precision line positioning capabilities to display high resolution geometric shapes and/or dynamic geometry without observable chatter. Where graphical data is to be stroke scanned, resolution is the minimum capable spatial movement of a displayed point and is expressed as incremental positional resolution (i.e., an incremental positional resolution of 0.005 inch).

The following, then, lists typical resolution requirements of active matrix LCDs based on known CRT displays for avionic applications. Some known displays are stroke written color, shadow mask CRTs having 0.3 mm pitch delta-dot color triads and 50% peak luminance beam diameters of approximately 0.3 mm to 0.6 mm. Other known displays require a resolution which should approximate that of a high resolution shadow mask (0.2 mm) in combination with a 0.015 inch spot width at 50% points. For a 5 inch shadow mask CRT display having a delta-dot color triad pitch of 0.2 mm a display horizontal resolution of not less than 65 line pairs per inch at 10% modulation as displayed on the display surface is known.

A minimum resolution for a known head down display is 2 TV lines (1 line pair) per milliradian of visual arc on the display. Based on this criteria, the minimum resolution of the display system is determined as follows:

(a) Let the horizontal and the vertical resolution be equal.

(b) Let the minimum viewing distance be 27 inches.

(c) At 2 TV lines per milliradian, the line separation is=(2) (27) sin (0.0005/2 rad).

(d) The TV line density is the reciprocal of line separation and is=(1/0.0135)=74.074 TV lines/inch.

(e) The spatial frequency is one-half the TV line density, and is = (0.5) (74.074)
= 37.037 line pairs (cycles)/inch.

Human factors data indicates that although resolution of less than 1 minute of arc is obtainable (observable under ideal conditions), 2-to-3 minutes is more reasonable, and 3 minutes is a good choice under most viewing conditions. The line pair spacing (alternate ON and OFF lines) for 2 minutes of arc at an approximate viewing distance of 27 inches is, $$\text{line pair spacing} = [2r * \sin(Q/2)]$$

where
r=viewing distance
Q=resolvable viewing angle.

Line pair spacing = (2) (27) sin (2/60 * 1/2)
= 0.0157 inch and, line pair density = (1/0.0157)
= 63.66 line pairs (cycles)/inch.

The beam modulation transfer function (MTF) for a raster scanned monochrome CRT display is a measure of the effective luminance response resultant from a sine wave modulted electron beam as shown in FIGS. 1A-1H and is expressed as follows:

$$MTF = [Lmax - Lmin]/[Lmax + Lmin]$$

where Lmax is the measured peak luminance and Lmin is the measured valley luminance.

By analysis, it can be determined that MTF degrades as either beam diameter increases or modulation frequency increases. For example, allow the beam diameter of a raster scanned CRT display to be approximately 1 inch in diameter. In such a case, the spatial modulation frequency (i.e., cycles/inch), to be optically noticeable, would necessarily be less than the spot diameter and, hence, no useful information could be presented to the viewer. In like manner, allow the space-frequency modulation of a normal spot width CRT display to be so high that before the ON electron beam can be deflected (moved) a beam-width distance from its initial ON location, the beam is successively modulated OFF and again ON. Under such an operational condition, the particular spot position on the display surface would merely display a 'blur' from which no useful information could be deciphered.

In flat panel matrix displays there can be no luminance modulation or luminance variation within a pixel, hence, MTF can only be determined at space-frequencies less than the pixel spacing. Pixel size and spacing in matrix displays is, then, analogous to CRT spot size and spatial frequency.

Further to the above quantitative MTF expression are several analytical expressions developed by display designers. These expressions aid the display designer in determining CRT spot diameter (matrix pixel size), video amplifier bandwidth requirements (space-frequency), and shadow mask pitch (matrix pixel spacing) when display performance is specified. Three common analytical MTF expressions follow:

$$MTF = e^{-2(pi * f * a)2}$$

where
pi=3.14
f=spatial frequency, cycles/unit length
a=spot radius at 60.7% luminance (approximately 3/7 spot diameter at 50% luminance).
$MTF=e^{-(1/12)}(pi * f * d)^2$
where
pi=3.14
f=spatial frequency, cycles/unit length
d=spot diameter at 5% luminance.

$$MTF=e^{-3.56(f * d)2}$$

where
F=spatial frequency, cycles/unit length
D=spot diameter at 50% luminance.

For these analytical MTF equations, it is assumed that the spot profile is gaussian, which is practically valid. For a gaussian symmetric electron beam, the current density profile (i.e., the luminance intensity profile), J, can be expressed as $$J=e^{-12(r/d)2}$$

where
r=distance from beam center
d=the value of 2r for which the current density has decreased to 5% of its center value as shown in FIG. 2.

The resolution of shadow mask CRTs is determined by their beam diameters and their shadow mask pitch (i.e., color triad pitch). The two most common triad phosphor arrangements, and the only ones currently in use in avionic products, are the delta-dot and the striped shown in FIGS. 3A and 3B. The deltadot triads typically have a red phosphor dot 100, a blue phosphor dot 102 and a green phosphor dot 104. The pitch 106 is the distance from the center of a selected color dot, such as red phosphor dot 100, to the center of the red phosphor dot 108 of the adjacent triad. The pitch 110 of the striped triad is the total width of the red phosphor stripe 112, the blue phosphor stripe 114 and the green phosphor stripe 116. For the same triad pitch, delta-dot triads provide the greatest resolution with the least triad structure visibility. For stripped or slotted type shadow mask CRTs to exhibit the equivalent resolution of delta-dot shadow mask CRTs, their pitch 110 must be reduced by the multiple (cos30) as shown in FIG. 3A by line 118, thereby requiring greater physical resolution within the CRT structures than that of communsurate resolution delta-dot shadow mask CRTs. Hereinafter, then, only delta-dot triad arrangements will be analyzed when referring to shadow mask type CRT displays.

To preclude Moire or interference patterns (i.e., beats between the scanning pattern and the shadow mask) caused by too small beam diameters, it has been experimentally determined that the 50% luminance beam widths of shadow mask CRTs should not be less than the shadow mask pitch. This bench mark establishes the spatial frequency, vs. beam MTF curve as determined by the MTF equations given above. It has been determined that the 50% luminance beam widths should not be less than 1.1 or 1.2 times the pitch for shadow mask CRT text displays (i.e., personnel computer text displays). The analysis, then, bears out that for practical purposes the minimum 50% beam width of avionic displays (i.e., scenic raster, graphic raster, and graphic stroke) should not be less than the mask pitch.

The presence of the shadow mask detracts from resolution. In fact, the resolution of the shadow mask is described by the spacefrequency characteristic resultant from the beam sampling due to the shadow mask holes. This space-frequency response, Y, is determined from the following equations:

$$Ymax=\cos[(q/2) * pi * b * u]$$

$$Ymin=\cos[(q/2) * pi * b * u]\cos[(pi/2) * (2-abs(q)) * b * u]$$

where
u=spatial frequency
b=equivalent mask-hole pitch in the horizontal direction (i.e., p * cos 30)
q=2[1/(2bu)−1/(2bu)+0.5 ]
pi=3.14
p=shadow mask pitch.

Figure 4:
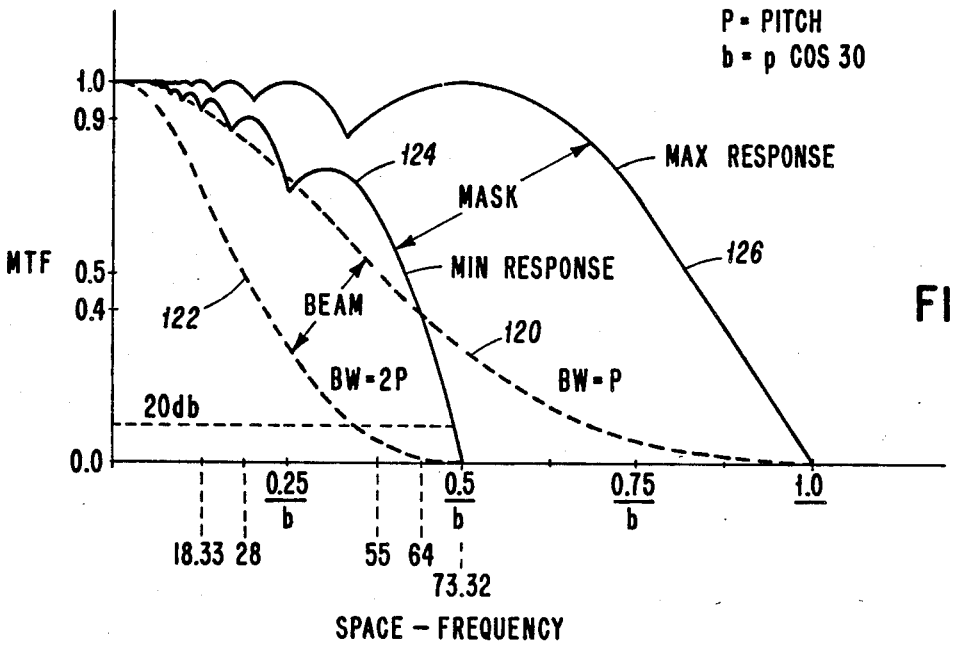
FIG. 4 is a graph of electron beam and shadow mask modulation transfer functions vs. space-frequency.

Plots of beam MTF and shadow mask MTF vs. space-frequency are shown in FIG. 4. The beam MTFs are plotted for the two cases where (a) the 50% peak luminance beam width (BW) is equal to the shadow mask pitch (curve 120) and where (b) it is equal to two times the pitch (curve 122). The highest spatial sampling frequency of the mask is (1/b). To arrive at an overall MTF for the shadow mask CRT display system, the beam response is multiplied by the mask response as a function of space-frequency.

Flat panel matrix displays, like shadow mask CRT displays, sample the video signals to be displayed. The spatial sampling frequency of matrix displays is identical to that of shadow mask CRTs when the matrix arrangement is a delta-dot pattern (triad) and when the two triad patterns are identically dimensioned. For other than delta-dot patterns, the spatial sampling freuency is a function of the pixel or triad spacing.

The mask resolution of delta-dot shadow mask CRTs can be determined from known prior art methods and is shown in figure 4. Visible space-frequency modulation is affected by the shadow mask pitch. Objectionable luminance intermodulations are observed for space-frequencies above (0.5/b) (defined below and in FIG. 4) because of high max/min mask MTF ratios. For spacefrequencies below (0.5/b) the max/min mask MTF ratios greatly diminish and luminance intermodualtions become progressively less noticeable. The minimum (curve 124) and maximum (curve 126) shadow mask resolutions (MTFs) are
MTFmin=0.0 at a space-frequency of 0.5/b
MTFmax=1.0 at a space-frequency of 0.5/b
where b=p * cos 30
p=pitch of shadow mask With respect to a 0.3 mm shadow mask CRT display, the spacefrequency at which these min-max MTFs occur is 49 line pairs (cycles)/inch and for a 0.2 mm pitch shadow mask CRT display, 74 line pairs (cycles)-/inch.

The beam resolution of CRT displays is determined with the aid of the MTF expressions given above and is also shown in FIG. 4. For the case where the 50% luminance beam diameters are equal to the shadow mask pitch and the space-frequency is 49 cycles/inch, $$MTFbeam=0.3$$

and the overall MTF (i.e., mask MTF multiplied by beam MTF) varies between 0 and 0.3. Such a variation of luminance response causes visible Moire patterns and the max/min luminance ratio 0.3/0.0 is considered objectionable.

To preclude oberservable space-frequency Moire effects, it has been determined that a 2/1 max/min mask MTF ratio should not be exceeded. The space-frequency with respect to the shadow mask pitch at which this occurs is approximately (0.4/b) or, for the 0.3 mm mask case, 40 cycles/inch. The reason for this reduction requirement is that deflected/modulated beam(s) of shadow mask CRT displays are not co-located with the mask apertures. At a space-frequency of 40 cycles/inch, then, the max/min shadow mask response is approximately 1.0/0.5, the beam MTF is approximately 0.45, and the overall max/min MTF ratio is 0.45/0.225 which is considered unobjectionable. At space-frequencies below (0.4/b), the max/min mask MTF ratios are always less than 2/1 and therefore present unobjectionable luminance intermodulations.

Figure 5:
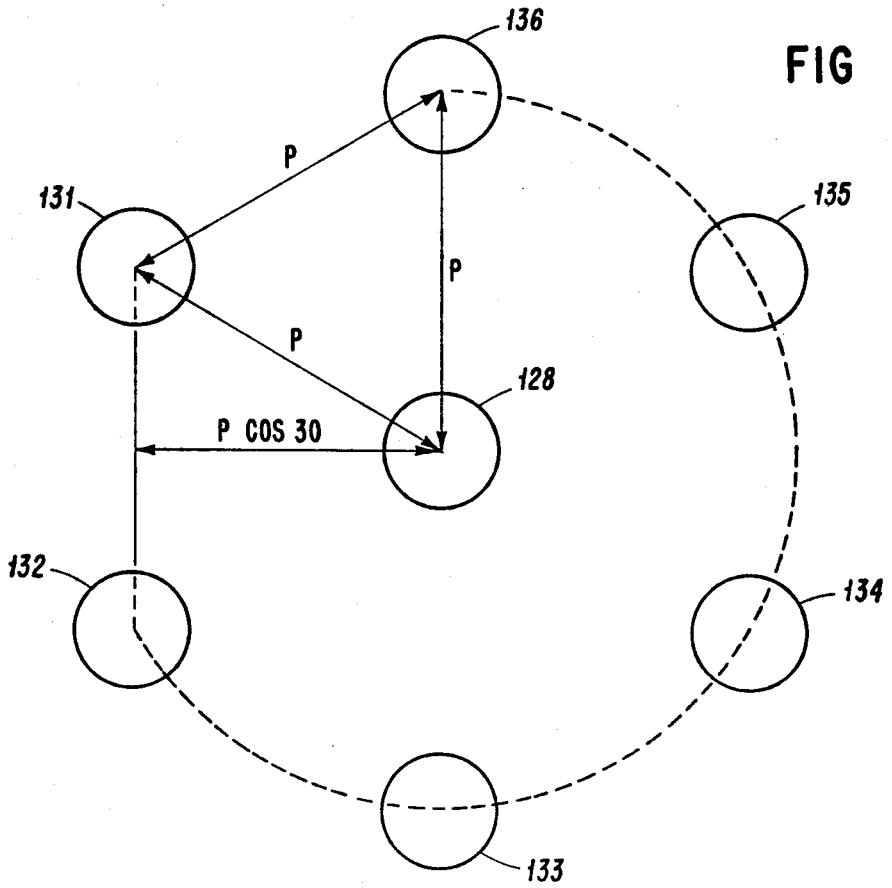
FIG. 5 is a drawing showing the size of the 5% luminance spot diameter equal to phosphor dot triad pitch.

Human factor experiments have determined that the visual diameter of a CRT spot is approximately described by the spot diameter at the 5% luminance level. Referring to the beam profile expression given above with reference to FIG. 2, it can be calculated that the 5% luminance spot diameter is approximately twice the 50% luminance spot diameter. To ascertain the spot diameter effects on shadow mask CRT displays, this spot diameter is joined to the delta-dot pattern shown in FIG. 5, wherein the 50% luminance spot diameter is allowed to be equal to the triad pitch, P. When the inner dot 128 has 100% luminous intensity the outer six dots, 131–136, have approximately 5% luminous intensity. When the centroid of the beam is deflected away from the center dot, the inner dot luminance will diminish while that dot toward which the centroid is closing will gradually increase in luminance, thus, preserving a 'visual' spot of fairly uniform luminance with picture dynamics. This scenario exemplifies why the 50% luminance beam(s) diameter(s) of shadow mask CRTs should not be less than the pitch of the mask.

It should be noted here that a displayed line width (spot diameter) can be so narrow as to make it difficult for the human eye to focus on the narrow line. This results from the two facts that a) the human eye naturally dithers and that b) the light sensing area of the human eye is an array of discrete light sensitive points. The minimum display resolution criteris of "2 minutes of arc", should be followed here (i.e., the effective, visual line width (i.e., spot width) should not be less than 2 minutes of arc). Because the 5% spot diameter is approximately twice that of the 50% spot diameter, and because the 5% spot is the visually effective spot width, the 5% spot width should not be less than 2 minutes of arc and the 50% spot width not less than 1 minute of arc for any display, regardless whether monochrome or shadow mask CRt or discrete matrix-flat panel.

Therefore, for 0.3 mm pitch shadow mask CRT displays, the maximum effective spatial frequency resolution (i.e., 0.4/b) is 40 line pairs (cycles)/inch, the minimum 50% beam diameter is 0.3 mm, and the effective minimum visual spot diameter is 0.6 mm. If the displayed data could be quantized so as to be colocated with the mask apertures prior to being displayed, and if the deflected beam could be co-located with the display surface triads, the minimum effective resolution (i.e., 0.5/b) would increase to 49 line pairs (cycles)/inch. This latter will be referred to as the reference resolution.

The resolution characteristics of 0.2 mm pitch shadow mask CRT displays can be determined by scaling the 0.3 mm pitch shadow mask data. For 0.2 mm pitch shadow mask CRT displays, then, the maximum effective spatial frequency resolution (i.e., 0.4/b) is 60 line pairs (cycles)/inch, the minimum 50% beam diameter is 0.2 mm, and the effective minimum visual spot diameter is 0.4 mm. The (0.5/b) reference resolution is 74 line pairs (cycles)/inch.

It is noted here that the resolution of 0.2 mm pitch shadow mask CRTs is 1 minute of arc between triads to a viewer positioned 27 inches from the display surface. This situation represents the practical human eye limit and hence defines the highest resolution needed for most avionic cockpit applications.

Matrix displays are composed of well defined patterns of discrete pixels, addressed through electronic control of row and column lines. The pixel resolution is, therefore, proportional to the number of row/column address lines per inch of usable display surface.

For matrix displays to be useful as high resolution monochrome or color avionic displays, (a) the displays must achieve effective resolutions equivalent to that of either 0.2 mm or 0.3 mm pitch delta-dot shadow mask CRTs, (b) the displays must present pictorial and/or graphical information with no visible interference from the matrix structures, and (c) the matrix structures should not be visible to the viewer.

To display video information (i.e., TV pictorial information) it is necessary for the display media to inherently possess gray shade capabilities. Gray shades are gradations of luminance, contrast, or half-tones by which visual information is sensed by the human eye. The usual gray shade gradation requirement for avionic displays is six (i.e., the ratio between each successive gray shade being the square root of two).

As stated above, CRT displays have the capabilities of continuous beam positioning and continuous beam luminance gradations. These capabilities provide CRT display designers with two techniques for incorporating graphical displays: (a) stroke written graphics and (b) raster scanned graphics. In order for raster scanned graphics to possess 'high resolution' characteristics (i.e., equivalent to stroke scanned graphics), anti-aliasing techniques must be used. These techniques require gray shade capabilities within the display media. Because matrix displays lack continuous pixel positioning (i.e., matrix displays, as previously stated, have well defined discrete pixel boundaries), graphical data cannot practically be stroke scanned onto matrix displays. To effectively display graphical data on matrix displays, raster techniques must be synthesized and used, and to display high resolution graphical data, anti-aliased raster techniques must be used.

To further the equivalence of CRT displays, and to minimize the visual detection of pixel edges, a "dot flair" technique can be incorporated. "Dot flair" renders each individual display generator addressed pixel into itself and its surrounding adjacent pixels, as shown in FIGS. 6A and 6B. FIG. 6A depicts a rectilinear pattern of pixels and FIG. 6B depicts a staggered pattern of pixels. A shown in FIG. 6A inner pixel 138 is activated to its designated luminance level and outer adjacent pixels, 141–148, are activated at a lower luminance, approximately 5–10% of the intensity of the inner pixel. This technique emulates the CRT spot and could be incorporated as part of the graphic anti-aliasing. (Refer to FIG. 2 for the spot shape to be emulated.)

Monochrome Graphic Matrix Display Resolution vs. 0.3 mm Pitch Mask

Based upon the acceptability of stroke written 0.3 mm pitch shadow mask CRTs to sufficiently display high resolution graphical data, it is ascertained that monochrome graphic matrix displays must emulate the same level of resolution. This acceptability is contingent upon achieving the same triad density which, by reference to FIG. 7 is, pixel density = 1/(horizontal triad spacing * vertical triad spacing)

1/(0.26 * 0.3)

1 triad per 0.078 $mm^2$ or, 12.82 triads per square mm (8,270 triads per square inch). For monochrome graphic displays, the pixel density is pixel density = 1 pixel per 0.078 $mm^2$ or, 12.82 pixels per square mm (8,270 pixels per square inch).

To preclude visual detection of the display surface pixel structure, the pixel size and spacing should approximate the resolvable limit of the human eye. The pixel size and spacing should exhibit a visual angular resolution of approximately 1 minute of arc. At a nominal viewing distance of 27 inches, the pixel spacing is $$\text{pixel spacing} = 2 * 27 * \sin(1/60 * 1/2) = 0.0078 \text{ inch } (0.2 \text{ mm})$$

From this analysis it is judged that monochrome pixel or color triad spacings more resolute than 0.2 mm do not appreciably add to the visual performance of the matrix display (i.e., this assumes incorporation of anti-aliasing and dot flair).

Figure 8:
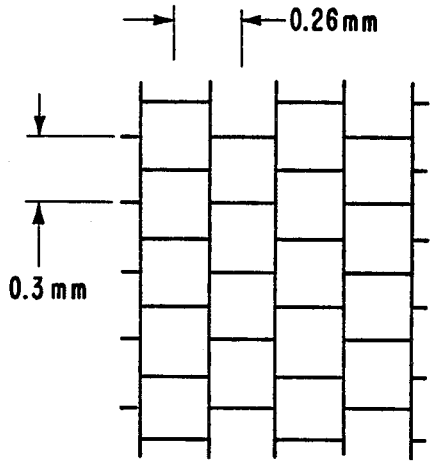
FIG. 8 is a drawing representing monochrome graphic matrix display resolution corresponding to a 0.3 mm pitch mask and having a staggered pattern of pixels.

Based upon criteria of the phosphor dot arrangement of the 0.3 mm pitch shadow mask CRT, an acceptable pixel pattern structure is that which emulates the 0.3 mm pitch shadow mask. Such a pattern would be an identical arrangement of the delta-dot pattern shown in FIG. 5, where p is 0.3 mm. An example of such a matrix pattern is shown in FIG. 8 where $$\begin{aligned} \text{horizontal pixel spacing} &= p * \cos 30 \\ &= 0.3 * \cos 30 \\ &= 0.26 \text{ mm} \\ \text{and, vertical pixel spacing} &= 2 * p * \sin 30 \\ &= 2 * 0.3 * \sin 30 \\ &= 0.3 \text{ mm.} \end{aligned}$$

Figure 9:
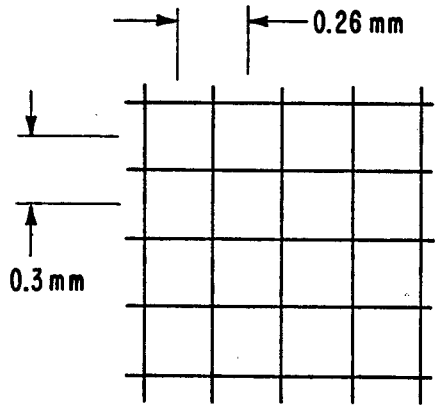
FIG. 9 is a drawing representing a rectilinearized pattern of pixels corresponding to the FIG. 8 structure.

The delta-dot pattern of FIG. 7 can be rectilinearized as shown in FIG. 9, wherein $$\begin{aligned} \text{horizontal pixel spacing} &= p * \cos 30 \\ &= 0.3 * \cos 30 \\ &= 0.26 \text{ mm} \\ \text{and, vertical pixel spacing} &= 2 * p * \sin 30 \\ &= 2 * 0.3 * \sin 30 \\ &= 0.3 \text{ mm.} \end{aligned}$$

Based upon this anaylsis, the horizontal and vertical pixel spacing of matrix display having a resolution of a 0.3 mm pitch mask should not be greater than 0.26 mm and 0.3 mm, respectively, regardless of the pixel pattern, and pixel spacings need not be less than 0.2 mm in either direction. The least row/column interconnect is that pattern described by 0.26 mm and 0.3 mm horizontal-vertical pixel spacing.

Color Graphic Matrix Display Resolution vs. 0.3 mm Pitch Mask

Based upon the acceptability of stroke written 0.3 mm pitch shadow mask CRTs to sufficiently display color, high resolution graphical data, it is ascertained that color graphic matrix displays should emulate the same level of resolution.

Figure 10:
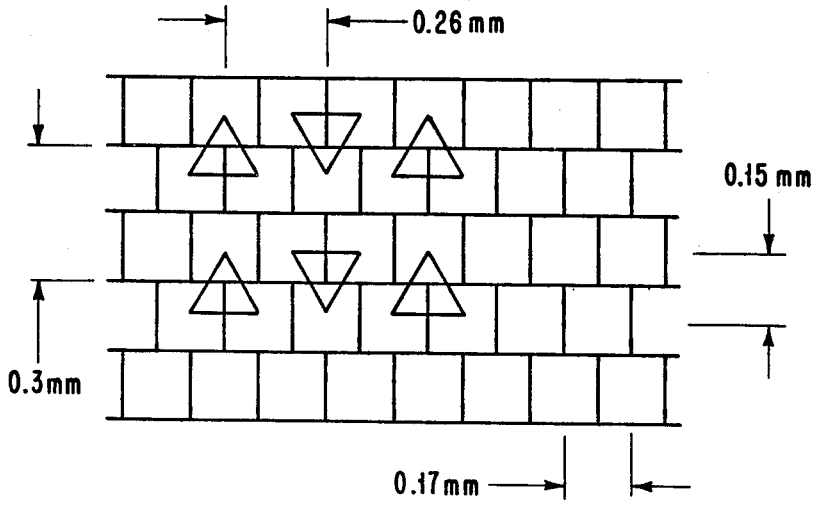
FIG. 10 is a drawing representing color graphic matrix display resolution corresponding to a 0.3 mm pitch mask.

As set forth below, triad spacings need not be more resolute than 0.2 mm. Also based upon FIG. 9, a delta-dot pattern of the 0.3 mm pitch shadow mask CRT is shown in FIG. 10. As shown in this Figure, the horizontal triad pitch = 0.26 mm vertical triad pitch = 0.3 mm $$\begin{aligned} \text{horizontal column spacing} &= (1/1.5)\,(p * \cos 30) \\ &= (1/1.5)\,(0.3 * \cos 30) \\ &= 0.173 \text{ mm} \\ \text{and, vertical row spacing} &= (1/2)\,(2 * p * \sin 30) \\ &= (1/2)\,(2 * 0.3 * \sin 30) \\ &= 0.15 \text{ mm} \end{aligned}$$

Therefore, for high resolution color graphic matrix displays to be equivalent to 0.3 mm pitch shadow mask CRTs, the horizontal traid pitch should be approximately 0.26 mm and the vertical triad pitch should be approximately 0.3 mm. The horizontal column spacings should be approximately 0.17 mm and the vertical row spacings approximately 0.15 mm.

Monochrome Scenic Video Matrix Display Resolution vs. 0.3 mm Pitch Mask

Based upon the acceptability of raster displays using 0.3 mm pitch shadow mask CRTs to display scenic raster, it is ascertained that monochromatic scenic video matrix displays must emulate the same level of resolution. The horizontal reference resolution (i.e., 0.5/b) is 48.88 line pairs (cycles)/inch and the horizontal effective resolution (i.e., 0.4/b) is 39.10 line pairs (cycles)-/inch.

As set forth above, pixel spacings need not be more resolute than 0.2 mm. Based upon criteria that the minimum effective horizontal resolution of the display (i.e., 0.4/b) is 39.10 horizontal line pairs (cycles)/inch and to achieve this resolution requires that the display be designed to the reference resolution (i.e., 0.5/b) or 48.88 line pairs (cycles)/inch, the minimum horizontal pixel spacing is $$\text{horizontal pixel spacing} = 1/(2 * 48.88) = 0.010 \text{ inch } (0.26 \text{ mm}).$$

Therefore, horizontal pixel spacing of the monochromatic scenic video display should not be greater than 0.26 mm and need not be less than 0.2 mm. The vertical pixel spacing may be based upon the scan line structure (i.e., 525, 626, or 875 lines per frame per usable display height), but should be within the range of 0.2 mm and 0.26 mm for best pixel symmetry.

Color Scenic Video Matrix Display Resolution vs. 0.3 mm Pitch Mask

Based upon the acdeptability of raster displays using 0.3 mm pitch shadow mask CRTs to display scenic raster, it is ascertained that color scenic video matrix displays must emulate the same level of resolution. The horizontal reference resolution (i.e., 0.5/b) is 48.88 line pairs (cycles)/inch and the horizontal effective resolution (i.e., 0.4/b) is 39.10 line pairs (cycles)/inch.

Again as set forth above, triad spacing need not be more resolute than 0.2 mm. To preclude scanning Moire patterns in shadow mask CRTs because of an inherent inability to accurately steer the beam(s) landings into the mask apertures, raster scanned shadow mask CRT displays always have their beam(s) scanned across the shadow mask in the direction shown by the arrow 150 in FIG. 11A. This gives rise to a horizontal reference resolution of $$\begin{aligned}\text{horizontal reference resolution} &= 1/(2 * p \cos 30)\\ &= 1/(2 * 0.3 * \cos 30)\\ &= 1.924 \text{ line pairs (cycles)/mm}\\ &= 48.88 \text{ line pairs (cycles)/inch.}\end{aligned}$$

With flat panel matrix displays, there is no problem with matching the scanning lines with the matrix structure because each sacn line is co-located (coincident) with a particular vertical row address. Hence, scanning Moire patterns are not a problem. Because of this unique feature of matrix displays, video data may be scanned onto matrix media structure patterns orthogonal to normal CRT scanning directions. This is shown in FIG. 11B along with the corresponding increase in horizontal resolution. The horizontal reference resolution in FIG. 11B is $$\text{horizontal reference resolution} = 1/(2 * p * \sin 30)$$

and, for a horizontal reference resolution of 48.88 line pairs (cycles)/inch, the $$\begin{aligned}\text{triad pitch} = p &= 1/(2 * 48.88 * \sin 30)\\ &= 0.020 \text{ inch (0.52 mm)}\end{aligned}$$

$$\begin{aligned}\text{and the horizontal column spacing} &= (p * \sin 30)\\ &= 0.010 \text{ inch (0.26 mm).}\end{aligned}$$

Figure 12:
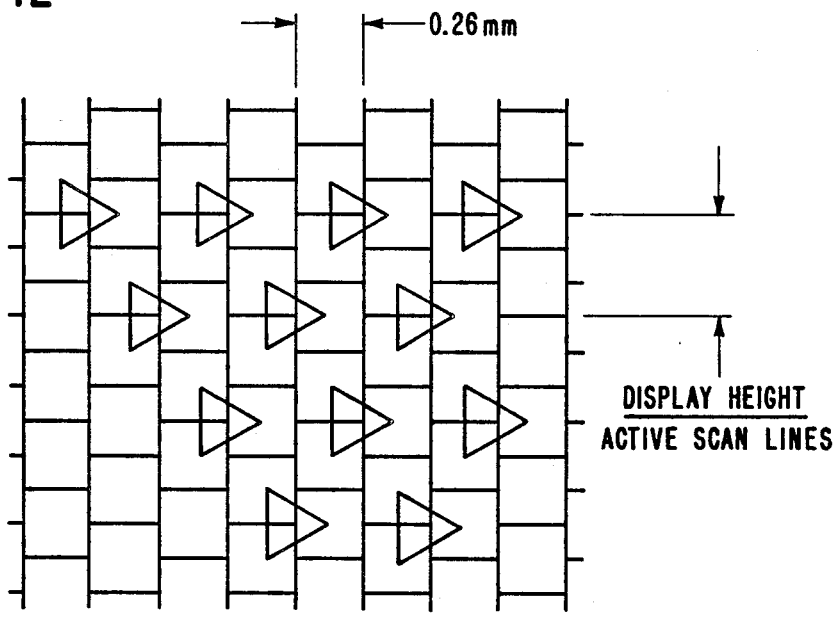
FIG. 12 is a drawing representing color scenic video matrix display resolution corresponding to a 0.3 mm pitch mask.

Therefore, horizontal triad spacing of a 0.3 mm equivalent color scenic video display should not be greater than 0.26 mm. As is in the case of the monochrome scenic video matrix display, the vertical triad spacing should not be greater than 0.26 mm, need not be less than 0.20 mm, and may be the ratio of display height to active scan lines. FIG. 12 depicts the panel display surface structure.

Monochrome Scenic Video Matrix Display Resolution vs. 0.2 mm Pitch Mask

Based upon the acceptability of raster displays using 0.2 mm pitch shadow mask CRTs to display scenic raster, it is ascertained that monochromatic scenic video matrix displays must emulate the same level of resolution. The horizontal reference resolution (i.e., 0.5/b) is 74 line pairs (cycles)/inch and the horizontal effective resolution (i.e., 0.4/b) is 60 line pairs (cycles)/inch.

As previously derived, pixel spacings need not be more resolute than 0.2 mm. For 0.2 mm pitch shadow mask CRT equivalent resolution, the data can be extrapolated from the data for the monochrome scenic video matrix display corresponding to a 0.3 mm pitch mark. The horizontal reference resolution (i.e., 0.5/b) is 74 line pairs (cycles)/inch, and, the horizontal pixel spacing is $$\begin{aligned}\text{horizontal pixel spacing} &= (0.2 \text{ mm pitch}/0.3 \text{ mm pitch})\ 0.26\\ &= 0.17 \text{ mm}\end{aligned}$$

Figure 13:
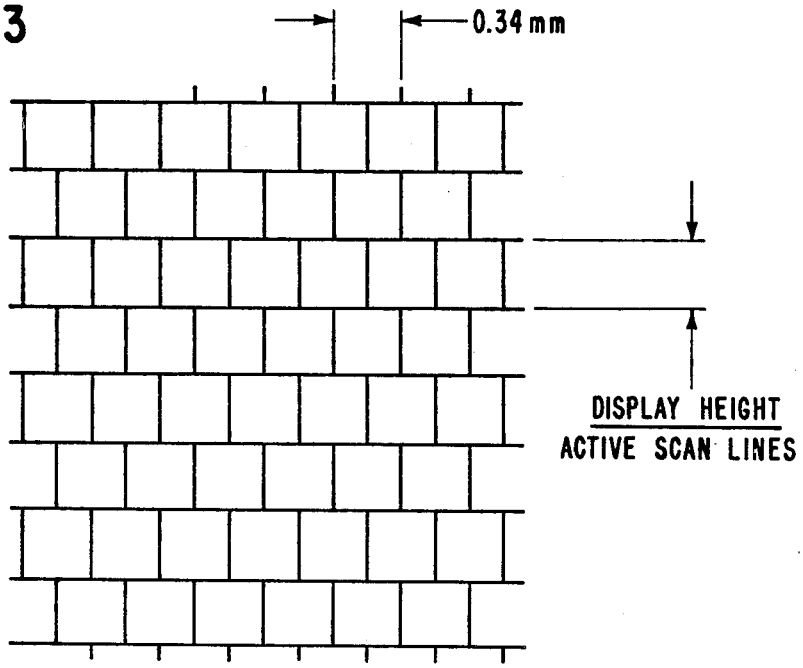
FIG. 13 is a drawing representing monochrome scenic video matrix display resolution corresponding to a 0.2 mm pitch mask.

By using a staggered display surface structure as shown in FIG. 13, the horizontal reference resolution is 74 line pairs (cycles)/inch and the horizontal column spacing is $$\begin{aligned}\text{horizontal column spacing} &= 2/(2 * 74)\\ &= 0.0135 \text{ inch (0.34 mm).}\end{aligned}$$

This analysis does not consider graphical data displays, and would not be as well suited for a graphical display application because of the large horizontal pixel size, because of the large horizontal-to-vertical pixel size ratio, and because of low pixel density.

Therefore, based upon this analysis, display surface structure shown in either FIG. 12 and 13 would provide the required 0.2 mm pitch shadow mask equivalent resolution. Because of the relatively large pixel size associated with FIG. 13, it is the least preferred solution.

Color Scenic Video Matrix Display Resolution vs. 0.2 mm Pitch Mask

Based upon the acceptability of raster displays using 0.2 mm pitch shadow mask CRTs to display scenic video raster, it is ascertained that color scenic video matrix displays must emulate the same level of resolution. The horizontal reference resolution (i.e., 0.5/b) is 74 line pairs (cycles)/inch and the horizontal effective resolution (i.e., 0.4/b) is 60 line pairs (cycles)/inch.

Again, triad spacing need not be more resolute than 0.2 mm. From the results for a color scenic video matrix display corresponding to a 0.3 mm pitch mask and a horizontal reference resolution (i.e., 0.5/b) of 74 line pairs (cycles)/inch for color scenic video matrix displays, the corresponding triad pitch is $$\begin{aligned}\text{triad pitch} = p &= 1/(2 * 74 * \sin 30)\\ &= 0.0135 \text{ inch (0.34 mm).}\end{aligned}$$

$$\begin{aligned}\text{horizontal column spacing} &= (p * \sin 30)\\ &= 0.00675 \text{ inch (0.17 mm).}\end{aligned}$$

Therefore, the horizontal triad spacing of a 0.2 mm equivalent color scenic video display should not be greater than 0.17 mm. The vertical triad spacing need not be less than 0.2 mm and may be the ratio of display height to active scan lines. FIG. 14 depicts the panel display surface structure.

Color Scenic Video Matrix Display Resolution vs. 0.2 mm Pitch Mask and Color Graphic Matrix Display Resolution vs. 0.3 mm Pitch Mask (Hybrid)

It can be demonstrated that 0.2 mm pitch display resolution equivalence is needed for high resolution scenic video displays (i.e., 65 line pairs (cycles)/inch horizontal resolution), and 0.3 mm pitch equivalence is needed and is sufficient for high resolution graphic displays. Refer to FIGS. 15A–D. FIG. 15A depicts the 0.2 mm pitch shadow mask CRT and 15B shows its transformation to a matrix display having the equivalent horizontal resolution. FIG. 15C shows the 0.3 mm pitch shadow mask used for graphical displays. Allow (1) that 0.17 mm horizontal pitch is needed to achieve the required horizontal resolution and (2) that dot density must approximate the 0.3 mm pitch shadow mask CRT equivalence to achieve the required pseudo-stroke line density, then (3) the dot density of FIG. 15C must equate to the dot density of FIG. 15D where the horizontal triad spacing is 0.17 mm. The vertical triad spacing for equivalent dot density is $$(0.15)\ (0.26)=(0.17)\ \text{(vertical triad spacing)}$$

$$0.23\ \text{mm}=\text{vertical triad spacing.}$$

FIG. 15D depicts the hybrid resolution requirement.

The following is a summary of preferred matrix display surface structures to achieve the described effective resolution. It is assumed that graphics are horizontally and vertically anti-aliased, and dot flair is incorporated.

0.3 mm Effective Monochrome Graphic Matrix Display Resolution

See FIG. 16A and 16B.

Horizontal pixel spacing=0.26 mm

Figure 17:
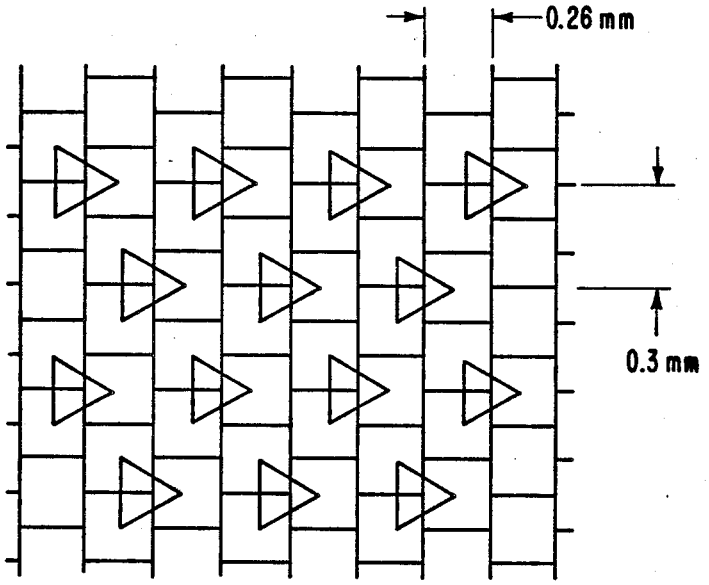
FIG. 17 is a drawing depicting a preferred embodiment of pixel structure for 0.3 mm effective color graphic matrix display resolution.

Vertical pixel spacing=0.26 mm 0.3 mm Effective Color Graphic Matrix Display Resolution See FIG. 17.

Horizontal triad spacing=0.26 mm

Vertical triad spacing=0.3 mm

Horizontal column spacing=0.26 mm

Figure 18A:
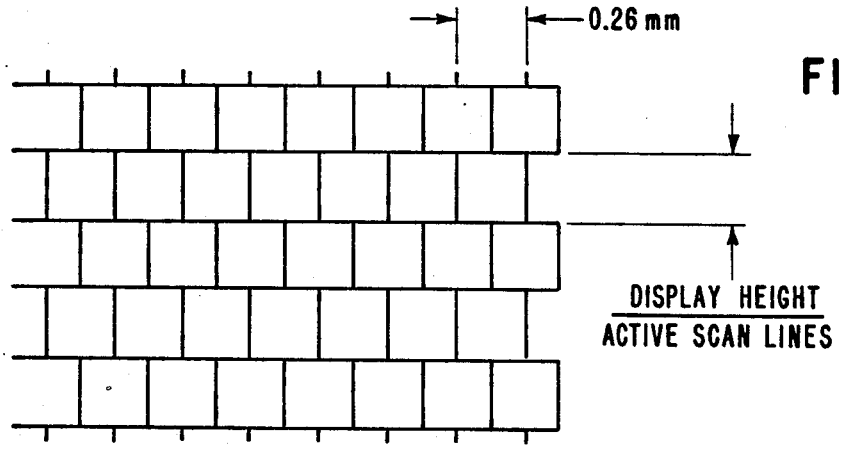
FIGS. 18A and 18B are drawings depicting a preferred embodiment of pixel structure for 0.3 mm effective monochrome scenic video matrix display resolution.
Figure 18B:
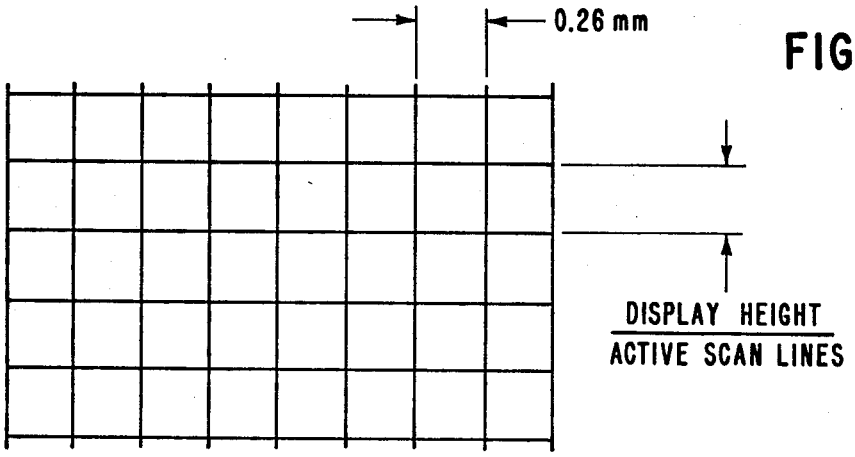

Vertical row spacing=0.15 mm 0.3 mm Effective Monochrome Scenic Video Matrix Display Resolution See FIG. 18A and 18B.

Horizontal reference resolution=60 line pairs (cycles)/inch

Horizontal effective resolution=48 line pairs (cycles)/inch.

Horizontal column spacing=0.26 mm

Figure 19:
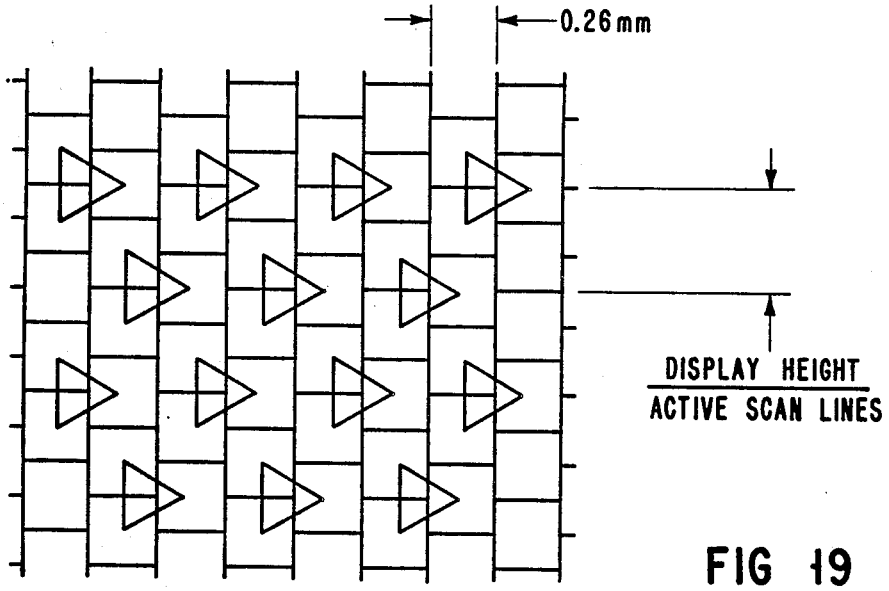
FIG. 19 is a drawing depicting a preferred embodiment of pixel structure for 0.3 mm effective color scenic video matrix display resolution.

Vertical row spacing=between 0.2 mm and 0.26 mm 0.3 Effective Color Scenic Video Matrix Display Resolution See FIG. 19.

Horizontal reference resolution=60 line pairs (cycles)/inch

Horizontal effective resolution=48 line pairs (cycles)/inch

Horizontal triad spacing=0.26 mm

Vertical triad spacing=between 0.2 mm and 0.26 mm may be=0.23 mm

Horizontal column spacing=0.26 mm

Figure 20A:
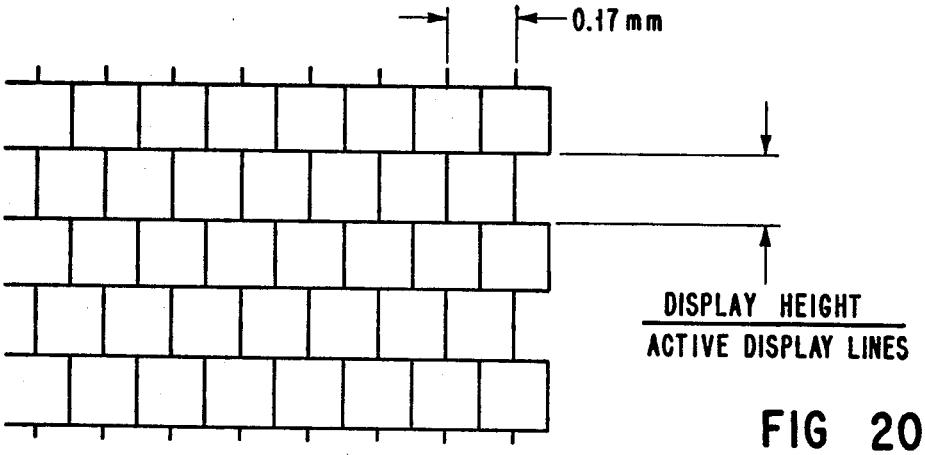
FIGS. 20A and 20B are drawings depicting a preferred embodiment of pixel structure for 0.2 mm effective monochrome scenic video matrix display resolution.
Figure 20B:
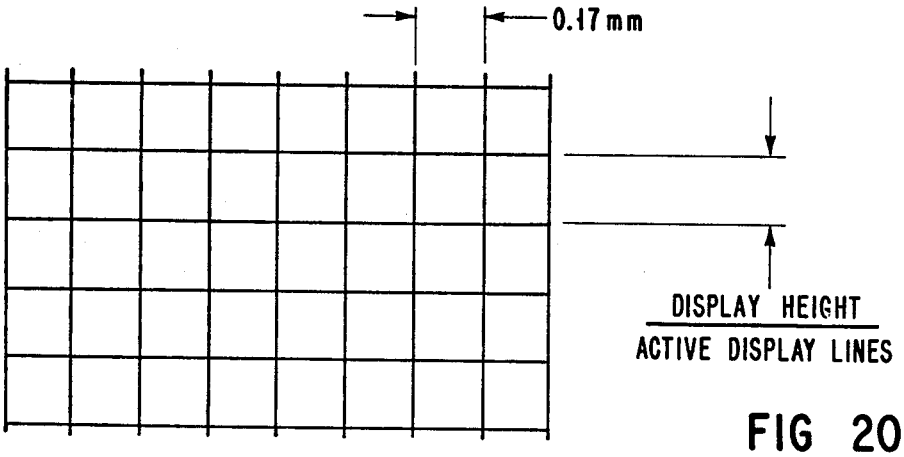

Vertical row spacing=between (0.2/1.5)=0.13 mm and (0.26/1.5)=0.17 mm may be=0.15 mm 0.2 mm Effective Monochrome Scenic Video Matrix Display Resolution See FIGS. 20A and 20B.

Horizontal reference resolution=74.7 line pairs (cycles)/inch

Horizontal effective resolution=60 line pairs (cycles)/inch

Horizontal column spacing=0.17 mm

Figure 21:
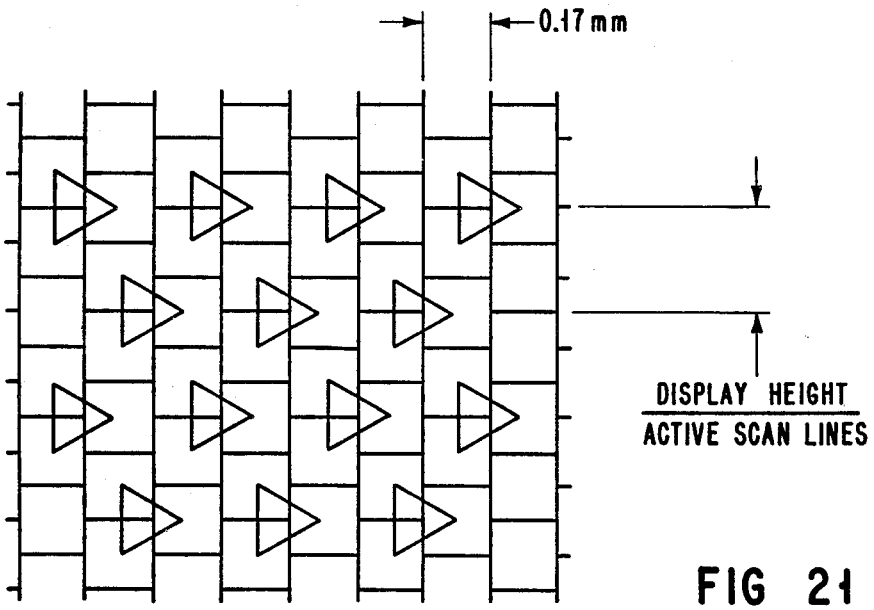
FIG. 21 is a drawing depicting a preferred embodiment of pixel structure for 0.2 mm effective color scenic video matrix display resolution.

Vertical row spacing=need not be less than 0.2 mm 0.2 mm Effective Color Scenic Video Matrix Display Resolution See FIG. 21.

Horizontal reference resolution=74.7 line pairs (cycles)/inch

Horizontal effective resolution=60 line pairs (cycles)/inch

Horizontal triad spacing=0.17 mm

Vertical triad spacing=need not be less than 0.2 mm may be=0.23 mm

Horizontal column spacing=0.17 mm

Vertical row spacing=need not be less than (0.2/1.5)=0.13 mm may be=0.15 mm

Hybrid 0.2 mm Scenic Video/0.3 mm Graphic

Figure 22:
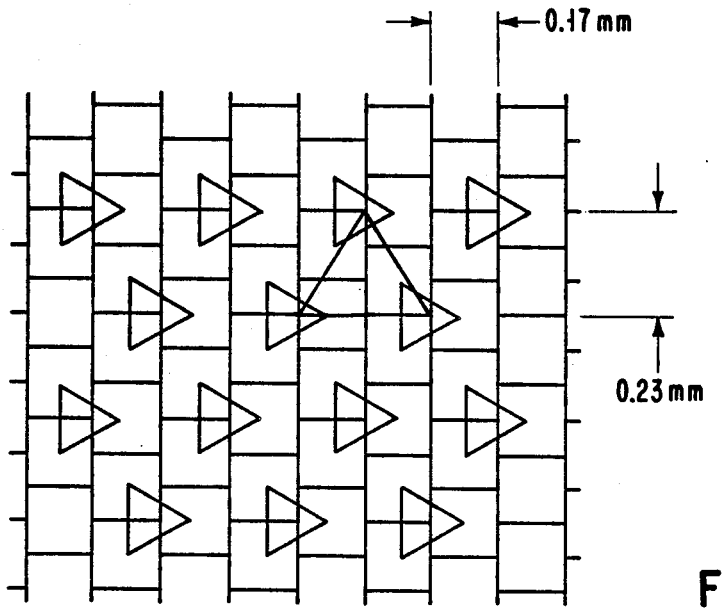
FIG. 22 is a drawing depicting a preferred embodiment of pixel structure for 0.2 mm effective color scenic video matrix display resolution and 0.3 mm effective color graphic matrix display resolution.

See FIG. 22.

Horizontal reference resolution=74.7 line pairs (cycles)/inch

Horizontal effective resolution=60 line pairs (cycles)/inch

Horizontal triad spacing=0.17 mm

Vertical triad spacing=0.23 mm

Horizontal column spacing=0.17 mm

Vertical row spacing=(0.23/1.5)=0.15 mm

* Practical horizontal column spacing=0.16 mm (160 lines/inch)

* Practical vertical row spacing=0.16 mm (160 lines/inch)

Some of the display generator requirements have been mentioned. Briefly, the display generator must do anti-aliasing and/or dot-flair to preclude "jaggies" on displayed graphic data, to preclude dynamic jitter because of inadequate positional resolution, and to effect line widths corresponding to visual acuity requirements. Also, it must quantize the data into identical row-column formats of the matrix displays. To effectively display sensor (TV) scenic video, the display generator must be capable of refreshing data to the LCD matrix display at a 60/30, 2-to-1 interlace, frame/field rate per second. The performance of this task in conjunction with the row-column data quantization may require scan conversion. Where more than one scan format is displayed, scan conversion is mandatory. Display generators having the above capabilities are known in the prior art and can be designed by one skilled in the art.

Should gray scales not be feasible, presently defined anti-aliasing techniques would not function properly, particularly with color (i.e., color shifting might occur). One solution to this problem is a higher resolution matrix. Incremental positional resolution in the order of 0.004 inch is required to preclude noticeable symbol chatter when displaying dynamic data. To effect this level of resolution would require row-column pixel or triad spacings in the order of 0.1 mm. To preclude too narrow line widths being displayed to the viewer in such a high-resolution matrix display, the display generator would need to artificially widen the viewable line width by forcing each pixel into, for example, a 4-by-4 pixel area.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A flat panel matrix display having a plurality of selectably activated pixels comprising:

a selected inner pixel being fully activated at a predetermined luminance level;

a plurality of adjacent pixels surrounding said inner pixel substantially simultaneously activated at a predetermined luminance level less than said luminance level of said inner pixel.

2. The flat panel matrix display described in claim 1, wherein said inner pixels are activated sequentially in a predetermined direction in a raster scan fashion.

3. The flat panel matrix display described in claim 1, wherein said adjacent pixels are luminated at a level in the range of approximately 5% to 10% of the level of lumination of said inner pixel.

4. The flat panel matrix display described in claim 1, wherein said pixels have a predetermined geometrical size and configuration which emulates a triad phosphor screen structure of a cathode ray tube.

5. The flat panel matrix display described in claim 4, wherein said size and configuration of said pixels is a function of the pitch of said triad phosphor screen structure.

6. The flat panel matrix display described in claim 1, wherein for producing a monochrone graphic matrix display and emulating a delta-dot triad cathode ray tube having a substantially 0.3 mm pitch mask, said flat panel matrix display has:

a predetermined pixel density;

horizontal pixel spacing between about 0.26 mm and 0.2 mm; and vertical pixel spacing between about 0.3 mm and 0.2 mm.

7. The flat panel matrix display described in claim 6, wherein columns of said pixels are staggered with respect to neighboring columns.

8. The flat panel matrix display described in claim 6, wherein said pixels are rectilinearized.

9. The flat panel matrix display described in claim 1, wherein for producing a color graphic matrix display and emulating a delta-dot triad cathode ray tube having a substantially 0.3 mm pitch mask, said flat panel matrix display has:

a predetermined pixel density, said pixels forming a plurality of color triads;

horizontal triad pixel spacing between about 0.26 mm and 0.2 mm;

vertical triad pixel spacing between about 0.3 mm and 0.2 mm;

horizontal column spacing of about 0.17 mm; and vertical row spacing of about 0.15 mm.

10. The flat panel matrix display described in claim 9, wherein rows of said pixels are staggered with respect to neighboring rows.

11. The flat panel matrix display described in claim 1, wherein for producing a monochrome scenic matrix display and emulating a delta-dot triad cathode ray tube having a subtantially 0.3 mm pitch shadow mask, said flat panel matrix display has:

a predetermined pixel density;

horizontal pixel spacing between about 0.26 mm and 0.2 mm; and vertical pixel spacing between about 0.26 mm and 0.2 mm.

12. The flat panel matrix display described in claim 11, wherein columns of said pixels are staggered with respect to neighboring columns.

13. The flat panel matrix display described in claim 11, wherein said pixels are rectilinearized.

14. The flat panel matrix display, described in claim 1, wherein for producing a color scenic matrix display and emulating a delta-dot triad cathode ray tube having a substantially 0.3 mm pitch mask, said flat panel matrix display has:

a predetermined pixel density said pixels forming a plurality of color triads;

horizontal triad pixels pacing between about 0.26 mm and 0.2 mm;

vertical triad pixel spacing between about 0.26 mm and 0.2 mm; and horizontal column spacing of about 0.26 mm.

15. The flat panel matrix display described in claim 14, wherein columns of said pixels are staggered with respect to neighboring columns.

16. The flat panel matrix display described in claim 14, wherein said vertical triad pixel spacing is approximately the ratio of the height of the color scenic matrix display to the number of active scan lines.

17. The flat panel matrix display described in claim 14, wherein said inner pixels are activated sequentially in a predetermined direction, orthogonal to the horizontal, in a raster scan fashion.

18. The flat panel matrix display described in claim 1, wherein for producing a monochrome scenic matrix display and emulating a delta-dot triad cathode ray tube having a substantially 0.2 mm pitch shadow mask, said flat panel matrix display has;

a predetermined pixel density;

horizontal pixel spacing about 0.17 mm; and vertical pixel spacing greater than 0.2 mm and approximately equal to the ratio of the height of the monochrome scenic matrix display to the number of active scan lines.

19. The flat panel matrix display described in claim 18, wherein columns of said pixels are staggered with respect to neighboring columns.

20. The flat panel matrix display described in claim 18, wherein the horizontal column spacing is approximately 0.34 mm.

21. The flat panel matrix display described in claim 1, wherein for producing a color scenic matrix display and emulating a delta-dot triad cathode ray tube having a substantially 0.2 mm pitch mask, said flat panel matrix display has:

a predetermined pixel density said pixels forming a plurality of color triads;

horizontal triad pixel spacing of approximately 0.17 mm;

vertical triad pixel spacing greater than 0.2 mm; and horizontal column spacing of about 0.17 mm..

22. The flat panel matrix display described in claim 21, wherein columns of said pixels are staggered with respect to neighboring columns.

23. The flat panel matrix display described in claim 21, wherein said vertical triad pixel spacing is approximately the ratio of the height of the color scenic matrix display to the number of active scan lines.

24. The flat panel matrix display described in claim 1, wherein for producing a color scenic matrix display emulating a delta-dot triad cathode ray tube having a substantially 0.2 mm pitch shadow mask and for also producing a color graphic matrix display emulating a delta-dot triad cathode ray tube having a substantially 0.3 mm pitch shadow mask, said flat panel matrix display has:

a predetermined pixel density, said pixels forming a plurality of color triads;

horizontal triad spacing of approximately 0.17 mm;

vertical triad spacing of approximately 0.23 mm; and horizontal column spacing of approximately 0.17 mm, columns of said pixels being staggered with respect to neighboring columns.

25. The flat panel matrix display described in claim 24, wherein vertical row spacing is approximately 0.15 mm.

26. The flat panel matrix display described in claim 1, wherein said flat panel matrix display has a pixel density of approximately 12.82 pixels per square millimeter.

* * * * *